US010184163B2

(12) United States Patent
Park

(10) Patent No.: US 10,184,163 B2
(45) Date of Patent: Jan. 22, 2019

(54) ALUMINUM ALLOY HAVING EXCELLENT FORMABILITY AND ELASTICITY AND METHOD OF PRODUCING THE SAME

(71) Applicants: HYUNDAI MOTOR COMPANY, Seoul (KR); KIA MOTORS CORPORATION, Seoul (KR)

(72) Inventor: Hoon Mo Park, Seongnam-Si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/058,830

(22) Filed: Aug. 8, 2018

(65) Prior Publication Data

US 2018/0347015 A1 Dec. 6, 2018

Related U.S. Application Data

(62) Division of application No. 14/709,255, filed on May 11, 2015, now Pat. No. 10,072,322.

(30) Foreign Application Priority Data

Nov. 19, 2014 (KR) ..... 10-2014-0161587

(51) Int. Cl.
*C22F 1/04* (2006.01)
*C22C 21/00* (2006.01)

(52) U.S. Cl.
CPC ..... *C22C 21/00* (2013.01); *C22F 1/04* (2013.01)

(58) Field of Classification Search
CPC ..... C22F 1/04
See application file for complete search history.

(56) References Cited

FOREIGN PATENT DOCUMENTS

| | | | |
|---|---|---|---|
| JP | S63-247334 | A | 10/1988 |
| JP | H03-223436 | A | 10/1991 |
| JP | H06-192780 | A | 7/1994 |
| JP | 2003-239030 | A | 8/2003 |
| KR | 10-2010-0105917 | A | 10/2010 |
| KR | 10-2012-0059256 | A | 6/2012 |
| KR | 10-2014-0021396 | A | 2/2014 |
| KR | 10-2014-0077061 | A | 6/2014 |
| KR | 10-2014-0078496 | A | 6/2014 |

OTHER PUBLICATIONS

English Abstract and English Machine Translation of Lee (KR 1020140078496) (Jun. 25, 2014).*
Korean Patent Office Action issued in corresponding Korean Patent Application No. 10-2014-0161587 dated Sep. 7, 2015 ; 6 pages.
Notice of Allowance issued in related U.S. Appl. No. 14/709,255 dated May 9, 2018.
Non-Final Office Action issued in related U.S. Appl. No. 14/709,255 dated Feb. 2, 2018.
Non-Final Office issued in related U.S. Appl. No. 14/709,255 dated Sep. 26, 2017.

* cited by examiner

*Primary Examiner* — Jessee R Roe
(74) *Attorney, Agent, or Firm* — McDermott Will & Emery LLP

(57) ABSTRACT

An aluminum alloy having excellent formability and elasticity includes Ti, B, Mg, and the Al, wherein a composition ratio of Ti:B:Mg is 1:3.5~4.5:1, and $AlB_2$ and $TiB_2$ are present as reinforcing phases.

7 Claims, 1 Drawing Sheet

| TYPE | SHAPE | DENSITY ($g/cm^3$) | ELASTICITY (GPa) | WEIGHT FRACTION | | | RATE OF INCREASE IN ELASTICITY (Gpa/wt%/Gpa/vol%) |
|---|---|---|---|---|---|---|---|
| | | | | 1wt% | 2wt% | 3wt% | |
| $TiB_2$ | ● | 4.5 | 570 | 72 (0.6 vol%) | 72.7 | 73.5 | 0.7/1.2 |
| $Al_3Ti$ | ▰ | 3.3 | 220 | 72 (0.82 vol%) | 72.7 | 73.4 | 0.7/0.8 |
| $AlB_2$ | ● | 3.2 | 277 | 72 (0.85 vol%) | 72.8 | 73.6 | 0.8/0.9 |
| Si | ▰ | 2.3 | 151 | 71.9 (1.15 vol%) | 72.6 | 73.2 | 0.7/0.6 |
| $MgB_2$ | ● | 2.64 | 300 | 72.4 (1.02 vol%) | – | – | 0.9/0.9 |

| TYPE | SHAPE | DENSITY ($g/cm^3$) | ELASTICITY (GPa) | WEIGHT FRACTION | | | RATE OF INCREASE IN ELASTICITY (Gpa/wt%/Gpa/vol%) |
|---|---|---|---|---|---|---|---|
| | | | | 1wt% | 2wt% | 3wt% | |
| $TiB_2$ | ● | 4.5 | 570 | 72 (0.6 vol%) | 72.7 | 73.5 | 0.7/1.2 |
| $Al_3Ti$ | ▬ | 3.3 | 220 | 72 (0.82 vol%) | 72.7 | 73.4 | 0.7/0.8 |
| $AlB_2$ | ● | 3.2 | 277 | 72 (0.85 vol%) | 72.8 | 73.6 | 0.8/0.9 |
| Si | ▬ | 2.3 | 151 | 71.9 (1.15 vol%) | 72.6 | 73.2 | 0.7/0.6 |
| $MgB_2$ | ● | 2.64 | 300 | 72.4 (1.02 vol%) | – | – | 0.9/0.9 |

ALUMINUM ALLOY HAVING EXCELLENT FORMABILITY AND ELASTICITY AND METHOD OF PRODUCING THE SAME

CROSS-REFERENCE(S) TO RELATED APPLICATIONS

The present application is a divisional of U.S. application Ser. No. 14/709,255 filed on May 11, 2015, which claims the benefit of priority to Korean Patent Application No. 10-2014-0161587, filed Nov. 19, 2014, the entire contents of both which are incorporated herein for all purposes by this reference.

TECHNICAL FIELD

Exemplary embodiments of the present inventive concept relate to an aluminum alloy having excellent formability and elasticity and a method of producing the same; and, particularly, to an aluminum alloy capable of maximizing generation of boron compounds so as to have improved strength and noise, vibration and harshness (NVH) characteristics, and a method of producing the same.

BACKGROUND

In general, collision absorption members for a vehicle are to absorb impacts from collisions with external objects and reduce pedestrian injuries during collisions with pedestrians, and representatively include bumpers provided at the front and rear of the vehicle.

The vehicle bumpers are configured of bumper covers and bumper back beams. Specifically, the bumper covers are mounted to the foremost and rearmost sides of the vehicle to define external appearances of the front and the rear thereof, and first undergo impacts transferred to the outside during collisions. The bumper covers are each provided with a buffer material therein in order to more easily absorb impacts transferred from the outside.

Meanwhile, each of the bumper back beams is located inside the associated bumper cover to absorb impacts transferred through the bumper cover, thereby serving to prevent damages of main parts such as a transmission and further to prevent injuries of occupants in the vehicle.

The bumper back beam is largely made of a steel material or a Glass Mat Thermoplastic (GMT) material.

In particular, the steel material has a relatively high strain and a heavy weight. For this reason, following a recent trend of vehicle lightening, a study on manufacturing of the bumper using a light material is actively ongoing. In this process, a light aluminum alloy tends to be actively applied to the vehicle.

Conventionally, a reinforcing phase such as a metal compound or carbon nanotube (CNT) is formed as a powder in order to improve elasticity of an aluminum alloy, but there is a limit in terms of cost competitiveness.

In addition, loss, wetting, and dispersion in molten aluminum may be caused when the reinforcing phase in the powdered form is inserted in a casting process. When only the reinforcing phase is added without an improvement of a base alloy, a cost increase and a difficulty of process control may be caused due to an increased amount of addition of the reinforcing phase for obtaining intended elasticity.

Thus, it is necessary to maximize generation of a boron compound playing a very important role in improvement of elasticity and to uniformly disperse the boron compound, generated by a spontaneous reaction, within the molten aluminum.

In the related art, a Korean conventional art entitled "An aluminum casting material including titanium boride and a method of producing the same" specifically discloses an aluminum alloy which has high elasticity compared to a conventional aluminum alloy without use of an expensive material such as carbon nanotube (CNT), and is applicable to all of general casting processes including high-pressure casting.

However, the above patent document does not resolve the problems such as loss, wetting, and dispersion in the molten aluminum during insertion of the reinforcing material in the powdered form, and the cost increase and the difficulty of process control due to the increased amount of addition of the reinforcing material.

The matters described as the related art have been provided only for assisting the understanding for the background of the present inventive concept and should not be considered as corresponding to the related art already known to those skilled in the art.

SUMMARY

An embodiment of the present inventive concept is directed to an aluminum alloy having excellent formability and elasticity and a method of producing the same, capable of improving elasticity and formability by optimizing a composition ratio to maximize generation of boron compounds such as $TiB_2$ and $AlB_2$ as reinforcing phases.

Other objects and advantages of the present inventive concept can be understood by the following description, and become apparent with reference to embodiments of the present inventive concept. In accordance with an embodiment of the present inventive concept, an aluminum alloy having excellent formability and elasticity includes Ti, B, Mg, and Al, wherein a composition ratio of Ti:B:Mg is 1:3.5~4.5:1, and $AlB_2$ and $TiB_2$ are present as reinforcing phases.

In certain embodiments, the aluminum alloy may include 0.4 to 1.2 wt % of Mg, 0.2 to 0.9 wt % of Si, 1 wt % or less of Ti, 2.5 to 5.5 wt % of B, and the remainder of Al.

In certain embodiments, the aluminum alloy may include 0.4 to 6.5 wt % of Zn, 0.4 to 1.2 wt % of Mg, 1 wt % or less of Ti, 2.5 to 5.5 wt % of B, and the remainder of Al.

In certain embodiments, the aluminum alloy may have an elastic modulus of 77 GPa or more, a dendrite arm spacing (DAS) below 30 μm, latent heat below 380 J/g, and a yield strength/tensile strength ratio below 54.

In accordance with another embodiment of the present inventive concept, a method of producing an aluminum alloy includes charging an Al—Ti master alloy, an Al—B master alloy, or a salt compound containing 75 wt % of Al into molten aluminum received in a melting furnace, wherein Ti:B:Mg are present in the molten metal in a ratio of 1:3.5~4.5:1, and stirring the molten aluminum using a stirring bar, wherein reinforcing phases $AlB_2$ and $TiB_2$ are generated by spontaneous reaction and dispersed.

In certain embodiments, the stirring bar may have a length equal to or more than 0.4 times the diameter of the melting furnace. In certain embodiments, the stirring may be performed at a speed of 500 rpm or more.

In certain embodiments, the Al—Ti master alloy may include 5 to 20 wt % of Ti and the remainder of Al. In certain embodiments, the Al—B master alloy may include 3 to 10 wt % of B and the remainder of Al.

BRIEF DESCRIPTION OF THE DRAWINGS

FIG. 1 is a diagram illustrating characteristics for each reinforcing material and a level of contribution of elasticity according to the same.

DETAILED DESCRIPTION

Exemplary embodiments of the present inventive concept will be described below in more detail with reference to the accompanying drawings. The present inventive concept may, however, be embodied in different forms and should not be construed as limited to the embodiments set forth herein. Rather, these embodiments are provided so that this disclosure will be thorough and complete, and will fully convey the scope of the present inventive concept to those skilled in the art. Throughout the disclosure, like reference numerals refer to like parts throughout the various figures and embodiments of the present inventive concept.

The present inventive concept relates to an aluminum alloy having excellent formability and elasticity and a method of producing the same, and simultaneously improves elasticity and formability by suppressing generation of $Al_3Ti$, as a reinforcing phase, adversely affecting formability while maximizing generation of $TiB_2$ and $AlB_2$ as reinforcing phases by a spontaneous reaction.

FIG. 1 is a diagram illustrating characteristics of each reinforcing phase and a level of contribution of elasticity according to the same using a digimat program.

As shown in FIG. 1, the level of contribution of elasticity is generated by a combination of shape, density, and the like of a reinforcing phase as well as simple elasticity of the reinforcing phase itself, and a rate of increase in elasticity may vary according to characteristics such as density even though the elasticity of the reinforcing phase itself is high.

In addition, the present inventive concept relates to an aluminum alloy having excellent formability and elasticity. The aluminum alloy should have high formability as well as elasticity in order to improve strength and NVH characteristics, and should have a light weight in order to reduce a weight of a vehicle body.

Accordingly, the elasticity of the reinforcing phase itself and the shape, density, and the like thereof should be complexly considered, and $TiB_2$, $AlB_2$ and the like which have a shape close to a relatively spherical shape and have a relatively high rate of increase in elasticity are preferable as reinforcing phases.

An aluminum alloy having excellent formability and elasticity according to an embodiment of the present inventive concept consists of Ti, B, and Mg, and in certain embodiments, a composition ratio of Ti:B:Mg satisfies 1:3.5~4.5:1 as a weight ratio.

When Ti and B are added to aluminum, reinforcing $TiB_2$ and $AlB_2$ having the highest level of contribution of elasticity may be formed. Elasticity and formability may be simultaneously improved by maximizing generation of $TiB_2$ and $AlB_2$, which simultaneously improve elasticity and formability while generation of $Al_3Ti$, which lowers formability of a material, is suppressed. In certain embodiments, the material is formed in an elliptical sphere shape having a large difference between a major axis and a minor axis when the weight ratio of Ti:B:Mg satisfies 1:3.5~4.5:1.

An aluminum alloy for a vehicle piston according to an embodiment of the present inventive concept may consist of 0.4 to 1.2 wt % of Mg, 0.2 to 0.9 wt % of Si, 1 wt % or less of Ti (exclusive of 0), 2.5 to 5.5 wt % of B, and the remainder of Al, and Ti:B:Mg may have a composition ratio of 1:3.5~4.5:1.

Thus, the above aluminum alloy may have improved elasticity and formability, compared to a commercial 6000 based aluminum alloy, as an Al—Mg—Si based aluminum alloy, including 0.4 to 1.2 wt % of Mg and 11 to 14 wt % of Si.

In addition, an aluminum alloy for a vehicle piston according to another embodiment of the present inventive concept may consist of 0.4 to 6.5 wt % of Zn, 0.4 to 1.2 wt % of Mg, 1 wt % or less of Ti (exclusive of 0), 2.5 to 5.5 wt % of B, and the remainder of Al, and Ti:B:Mg has a composition ratio of 1:3.5~4.5:1.

Thus, the above aluminum alloy may have improved elasticity and formability, compared to a commercial 7000 based aluminum alloy, as an Al—Zn—Mn based aluminum alloy, including 0.4 to 6.5 wt % of Zn and 0.4 to 1.2 wt % of Mg.

That is, the aluminum alloy according to the embodiments of the present invention is produced so as to have the composition ratio of Ti:B:Mg satisfying 1:3.5~4.5:1, thereby enabling elasticity and formability to be improved compared to the conventionally commercial 6000 based aluminum alloy and commercial 7000 based aluminum alloy.

According to the embodiments of the present inventive concept, elasticity, formability, and collision energy absorption may be simultaneously improved under an elastic modulus of 77 GPa or more, a DAS below 30 μm, latent heat below 380 J/g, and a yield strength/tensile strength ratio below 54. This is because of maximizing generation of $TiB_2$ and $AlB_2$ for simultaneously improving elasticity and formability while suppressing generation of $Al_3Ti$ lowering formability. Thus, it may be possible to simultaneously improve elasticity and formability of the material.

TABLE 1

| | Reinforcing Fraction | | | | | | | | | |
|---|---|---|---|---|---|---|---|---|---|---|
| Ti:B:Mg | $TiB_2$ | $AlB_2$ | α | $Al_3Cr_4Si_4$ | $Al_2Cu$ | Si | $Al_6Mn$ | $Mg_2Si$ | AlCrMgMn | $Al_2CuMg$ |
| 1:1:1 | 1.5 | 1.2 | 2.7 | 0.6 | 0.6 | 0.5 | — | — | — | — |
| 1:2.5:1 | 1.5 | 4.6 | 2.7 | 0.6 | 0.6 | 0.5 | — | — | — | — |
| 1:3.5:1 | 1.5 | 6.9 | 2.7 | 0.6 | 0.6 | 0.5 | — | — | — | — |
| 1:4.5:1 | 1.5 | 9.1 | 2.7 | 0.6 | 0.6 | 0.5 | — | — | — | — |
| 1:5.5:1 | 1.5 | 11.4 | 2.7 | 0.6 | 0.6 | 0.5 | — | — | — | — |
| 1:4.5:2 | 1.5 | 9.1 | — | — | — | — | 3.3 | 2.2 | 1.3 | 0.7 |
| 1:2.5:2.5 | 3.6 | 3.1 | — | — | — | — | 3.3 | 2.2 | 1.3 | 0.7 |

TABLE 2

| Ti:B:Mg | Si | Fe | Cu | Mn | Mg | Cr | Zn | Ti | B | Al | Elastic modulus GPA | DAS μm | Latent heat J/g | Tensile strength MPa | Yield strength MPa | Yield/ tension ratio | T6 strength - grain 50 μm | Melting point ° C. |
|---|---|---|---|---|---|---|---|---|---|---|---|---|---|---|---|---|---|---|
| 1:1:1 | 0.8 | 0.5 | 0.4 | 0.3 | 1 | 0.2 | 0.3 | 1 | 1 | Bal. | 72 | 29 | 398 | 178 | 96 | 54 | 259 | 640 |
| 1:1.5:1 | 0.8 | 0.5 | 0.4 | 0.3 | 1 | 0.2 | 0.3 | 1 | 1.5 | Bal. | 73 | 27 | 390 | 177 | 95 | 54 | 255 | 640 |
| 1:2.5:1 | 0.8 | 0.5 | 0.4 | 0.3 | 1 | 0.2 | 0.3 | 1 | 2.5 | Bal. | 75 | 29 | 393 | 256 | 142 | 56 | 247 | 640 |
| 1:3.5:1 | 0.8 | 0.5 | 0.4 | 0.3 | 1 | 0.2 | 0.3 | 1 | 3.5 | Bal. | 77 | 29 | 375 | 167 | 89 | 53 | 239 | 640 |
| 1:4.5:1 | 0.8 | 0.5 | 0.4 | 0.3 | 1 | 0.2 | 0.3 | 1 | 4.5 | Bal. | 79 | 29 | 364 | 164 | 88 | 54 | 232 | 640 |
| 1:2.5:2 | 0.8 | 0.5 | 0.4 | 0.3 | 2 | 0.2 | 0.3 | 1 | 2.5 | Bal. | 75 | 24 | 393 | 669 | 570 | 85 | 245 | 642 |
| 1:3.5:2 | 0.8 | 0,5 | 0.4 | 0.3 | 2 | 0.2 | 0.3 | 1 | 3.5 | Bal. | 77 | 23 | 379 | 556 | 443 | 80 | 239 | 642 |
| 1:4.5:2 | 0.8 | 0.5 | 0.4 | 0.3 | 2 | 0.2 | 0.3 | 1 | 4.5 | Bal. | 79 | 25 | 368 | 608 | 500 | 82 | 232 | 641 |
| 1:2.5:3 | 0.8 | 0.5 | 0.4 | 0.3 | 3 | 0.2 | 0.3 | 1 | 2.5 | Bal. | 74 | 21 | 380 | 502 | 384 | 77 | 359 | 637 |
| 1:3.5:3 | 0.8 | 0.5 | 0.4 | 0.3 | 3 | 0.2 | 0.3 | 1 | 3.5 | Bal. | 76 | 21 | 369 | 563 | 451 | 80 | 351 | 636 |
| 1:4.5:3 | 0.8 | 0.5 | 0.4 | 0.3 | 3 | 0.2 | 0.3 | 1 | 4.5 | Bal. | 78 | 21 | 356 | 623 | 522 | 84 | 342 | 635 |
| 1:2.5:4 | 0.8 | 0.5 | 0.4 | 0.3 | 4 | 0.2 | 0.3 | 1 | 2.5 | Bal. | 75 | 20 | 388 | 510 | 393 | 77 | 366 | 631 |
| 1:3.5:4 | 0.8 | 0.5 | 0.4 | 0.3 | 4 | 0.2 | 0.3 | 1 | 3.5 | Bal. | 77 | 20 | 374 | 563 | 450 | 80 | 357 | 631 |
| 1:4.5:4 | 0.8 | 0.5 | 0.4 | 0.3 | 4 | 0.2 | 0.3 | 1 | 4.5 | Bal. | 79 | 20 | 362 | 617 | 511 | 83 | 348 | 620 |
| 1:1:2.5 | 0.8 | 0.5 | 0.4 | 0.3 | 2.5 | 0.2 | 0.3 | 1 | ↑ | Bal. | 75 | 20 | 385 | 690 | 595 | 86 | 335 | 630 |
| 2.5:2.5:1 | 0.8 | 0.5 | 0.4 | 0.3 | 1 | 0.2 | 0.3 | 2.5 | 2.5 | Bal. | 76 | 28 | 388 | 170 | 91 | 54 | 247 | 640 |

Table 1 indicates a reinforcing fraction according to the composition ratio of Ti:B:Mg, and Table 2 indicates a physical property change according to the composition ratio of Ti:B:Mg (an initial cooling speed being 50° C./s). In Table 2, the unit for the amount of each component is wt %.

As indicated in Tables 1 and 2, when a Mg content exceeds the composition ratio, the generation of $AlB_2$ phase is increased but contents of reinforcing phases such as $Al_6Mn$ and $Mg_2Si$ are simultaneously increased. Thus, since an alloy behavior as in specific heat treatment is exhibited and a yield/tension ratio is increased, it may be seen that the collision energy absorption is lowered.

In addition, when a Ti content is excessive and a B content is insufficient, it may be seen that elasticity and grain refining factors fail to meet a reference value and thus the elasticity and the formability do not satisfy a reference value.

Meanwhile, when a B content is less than a threshold value of 2.5 wt % for simultaneous generation of $AlB_2$ and $TiB_2$, it may be seen that the collision energy absorption is excellent but the elasticity and the formability are lowered.

On the other hand, when the composition ratio of Ti:B:Mg according to the embodiment of the present inventive concept is satisfied and the B content is 2.5 to 5.5 wt %, the generation of $AlB_2$ and $TiB_2$ which are advantageous to elasticity and formability may be maximized and the elasticity and the formability may be simultaneously improved.

According to the embodiment of the present inventive concept. In Table 3, the unit for the amount of each component is wt %.

As indicated in Table 3, the elasticity of the aluminum alloy according to the embodiment of the present inventive concept may be improved by approximately 10%, compared to the commercial 6000 based aluminum alloy and commercial 7000 based aluminum alloy. In addition, it may be seen that the DAS and latent heat exhibiting the formability are similar or slightly decreased and the formability is slightly increased compared to the related art.

Accordingly, the aluminum alloy having excellent elasticity and formability according to the embodiment of the present inventive concept may have improved elasticity, formability, and collision energy absorption, compared to the commercial 6000 based aluminum alloy and commercial 7000 based aluminum alloy. Consequently, it may be possible to improve strength and NVH characteristics of the collision absorption members.

A method of producing an aluminum alloy having excellent elasticity and formability according to an embodiment of the present inventive concept includes a charging step of charging an Al—Ti master alloy, an Al—B master alloy, or an Al salt compound of 75 wt % into molten aluminum received in a melting furnace, and a stirring step of stirring the Al molten metal so as to generate and disperse reinforcing phases $AlB_2$ and $TiB_2$.

TABLE 3

| Aluminum Alloy | Si | Fe | Cu | Mn | Mg | Cr | Zn | Ti | B | Al | Elastic modulus GPA | DAS μm | Latent heat J/g | Tensile strength MPa | Yield strength MPa | Yield/ tension ratio | T6 strength - grain 50 μm | Melting point ° C. |
|---|---|---|---|---|---|---|---|---|---|---|---|---|---|---|---|---|---|---|
| 7075 | 0.4 | 0.5 | 1.2~ 2.0 | 0.3 | 2.1~ 2.9 | 0.18~ 0.28 | 5.1~ 6.1 | — | — | Bal. | 70 | 39 | 387 | 240 | 133 | 55 | 319 | 641 |
| 6061 | 0.4~ 0.8 | 0.7 | 0.15~ 0.4 | 0.2 | 0.8~ 1.2 | 0.04~ 0.35 | <0.25 | 0.15 | — | Bal. | 69 | 28 | 401 | 183 | 99 | 54 | 257 | 653 |
| Embodiment | 0.8 | 0.5 | 0.4 | 0.3 | variable | 0.2 | 0.3 | variable | variable | Bal. | 77 | <30 | <380 | — | — | <54 | — | — |

Table 3 indicates physical properties of the commercial 6000 based aluminum alloy (6061) and commercial 7000 based aluminum alloy (7075) and physical properties of the aluminum alloy having excellent elasticity and formability In the charging step, one or more of the Al—Ti master alloy, the Al—B master alloy, and the Al salt compound of 75 wt % are charged and a composition ratio of the molten metal satisfies Ti:B:Mg=1:3.5~4.5:1.

In this case, the Al—Ti master alloy charged into the molten metal may consist of 5 to 20 wt % of Ti and the remainder of Al, and the Al—B master alloy may consist of 3 to 10 wt % of B and the remainder of Al.

By maintaining the above ratio, it may be possible to simultaneously generate $TiB_2$ and $AlB_2$ for simultaneously improving elasticity and formability and to minimize generation of $Al_3Ti$ which is disadvantageous to formability and impact characteristics.

In certain embodiments, in the stirring step, in order to simultaneously generate and disperse $AlB_2$ and $TiB_2$ as reinforcing phases, the molten metal is stirred at a speed of 500 rpm or more. In certain embodiments, the stirring is performed using a stirring bar having a length equal to or more than 0.4 times the diameter of the melting furnace.

The length and stirring speed of the stirring bar affect the reaction speed and dispersion of the reinforcing phase. Therefore, in certain embodiments, the stirring bar should have a length equal to or more than 40% of the melting furnace. When the stirring speed is less than 500 rpm, a generation amount of $TiB_2$ may be insufficient due to generation of $Al_3Ti$ which is disadvantageous to the formability and the impact characteristics.

In addition, since the generated reinforcing phase is not uniformly dispersed in the molten metal, a physical property deviation may be caused according to a portion of the molten metal.

The present inventive concept may simultaneously generate and uniformly disperse $TiB_2$ and $AlB_2$ in the molten metal while suppressing generation of $Al_3Ti$ which is disadvantageous to the formability and the impact characteristics, through control of the composition ratio. Consequently, it may be possible to improve characteristics such as elasticity, formability, and collision energy absorption.

In accordance with the exemplary embodiment of the present inventive concept, it may be possible to simultaneously improve elasticity and formability of a material by optimizing a composition ratio of Ti, B, and Mg to maximize generation of $TiB_2$ and $AlB_2$ as reinforcing phases.

In addition, it may be possible to uniformly disperse boron compounds as the reinforcing phases by stirring $TiB_2$ and $AlB_2$ generated by a spontaneous reaction under an optimal condition within molten aluminum.

While the present inventive concept has been described with respect to the specific embodiments, it will be apparent to those skilled in the art that various changes and modifications may be made without departing from the spirit and scope of the inventive concept as defined in the following claims.

What is claimed is:

1. A method of producing an aluminum alloy, comprising:

charging an Al—Ti master alloy, an Al—B master alloy, or a salt compound containing 75 wt % of Al, in Al molten metal which is received in a melting furnace, wherein Ti:B:Mg are present in the molten metal in a ratio of 1:3.5~4.5:1; and stirring the Al molten metal using a stirring bar, wherein reinforcing phases $AlB_2$ and $TiB_2$ are generated by spontaneous reaction and dispersed.

2. The method of claim 1, wherein the stirring bar has a length equal to or more than 0.4 times the diameter of the melting furnace.

3. The method of claim 1, wherein the stirring is performed at a speed of 500 rpm or more.

4. The method of claim 2, wherein the Al—Ti master alloy comprises 5 to 20 wt % of Ti and the remainder of Al.

5. The method of claim 2, wherein the Al—B master alloy comprises 3 to 10 wt % of B and the remainder of Al.

6. The method of claim 3, wherein the Al—Ti master alloy comprises 5 to 20 wt % of Ti and the remainder of Al.

7. The method of claim 3, wherein the Al—B master alloy comprises 3 to 10 wt % of B and the remainder of Al.

* * * * *